United States Patent [19]

Sawyer

[11] 4,176,481

[45] Dec. 4, 1979

[54] PICTURE FRAME ASSEMBLY

[76] Inventor: Robert J. Sawyer, P.O. Box 368, Boyne City, Mich. 49712

[21] Appl. No.: 880,146

[22] Filed: Feb. 22, 1978

[51] Int. Cl.[2] ..... G09F 1/12

[52] U.S. Cl. ..... 40/156; 52/775

[58] Field of Search ..... 40/152, 152.1, 156; 52/775

[56] References Cited

U.S. PATENT DOCUMENTS

| | | | |
|---|---|---|---|
| 1,582,865 | 4/1926 | Bristol | 40/156 |
| 2,523,815 | 9/1950 | Cloyd | 40/156 |
| 2,581,843 | 1/1952 | Edwards | 40/156 X |
| 3,879,873 | 4/1975 | Sawyer | 40/156 |
| 4,017,989 | 4/1977 | Murray | 40/152 |
| 4,078,326 | 3/1978 | Reim | 40/152.1 |

FOREIGN PATENT DOCUMENTS

| | | | |
|---|---|---|---|
| 1393511 | 2/1965 | France | 40/152 |

*Primary Examiner*—Louis G. Mancene
*Assistant Examiner*—Wenceslao J. Contreras
*Attorney, Agent, or Firm*—Gifford, Chandler, Van Ophem, Sheridan & Sprinkle

[57] ABSTRACT

An inexpensive picture frame assembly including a one-piece substantially rectangular frame member having means for detachably receiving a plurality of decorative strips on the outer face thereof and locking means for mounting paintings or the like of various thicknesses for display in the frame member.

7 Claims, 4 Drawing Figures

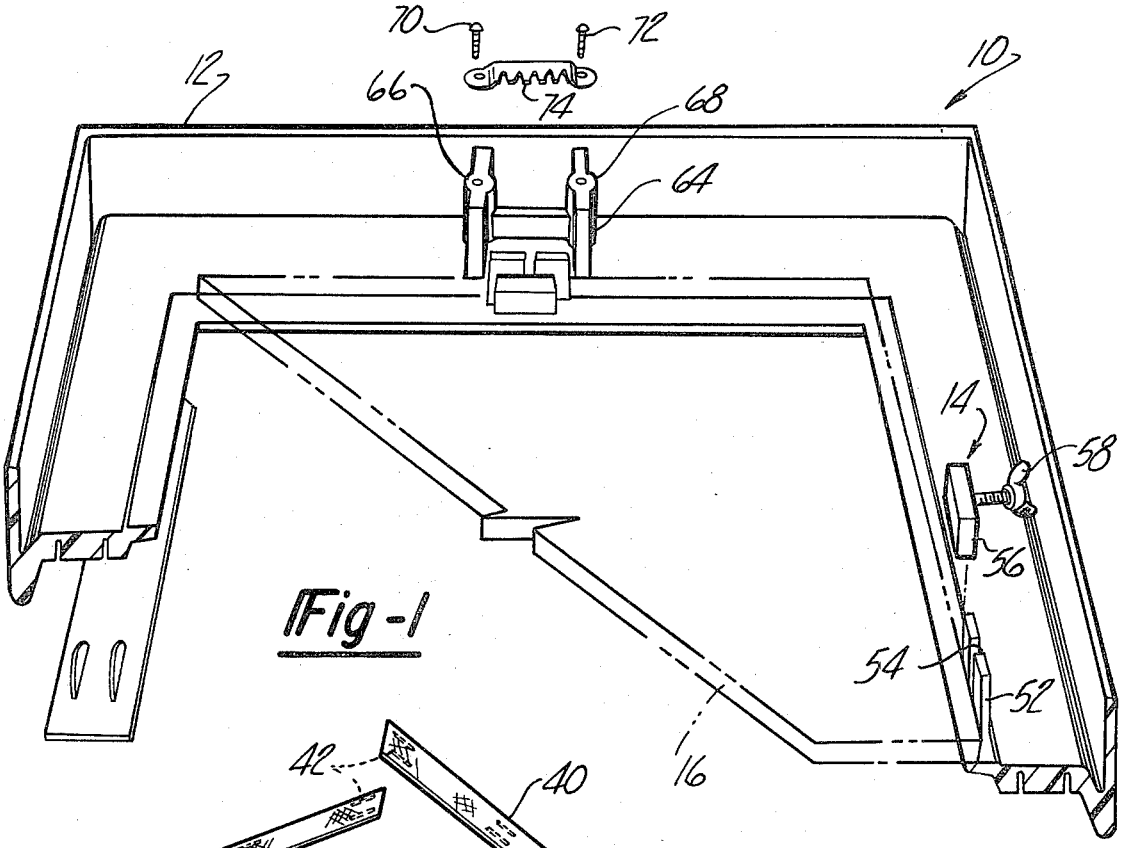
Fig-1
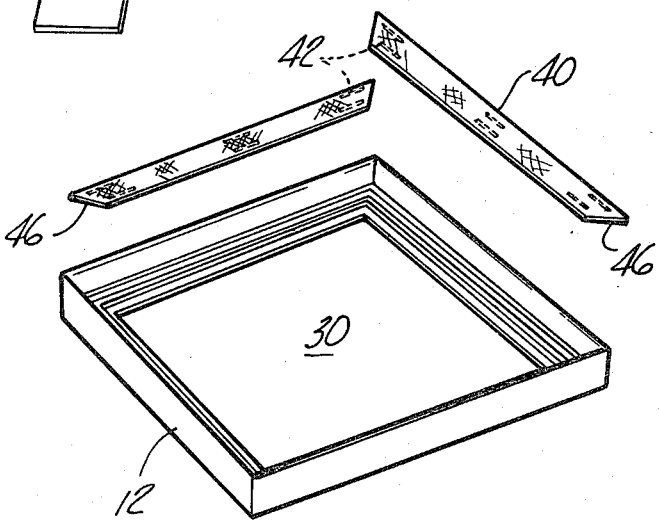
Fig-2
Fig-3
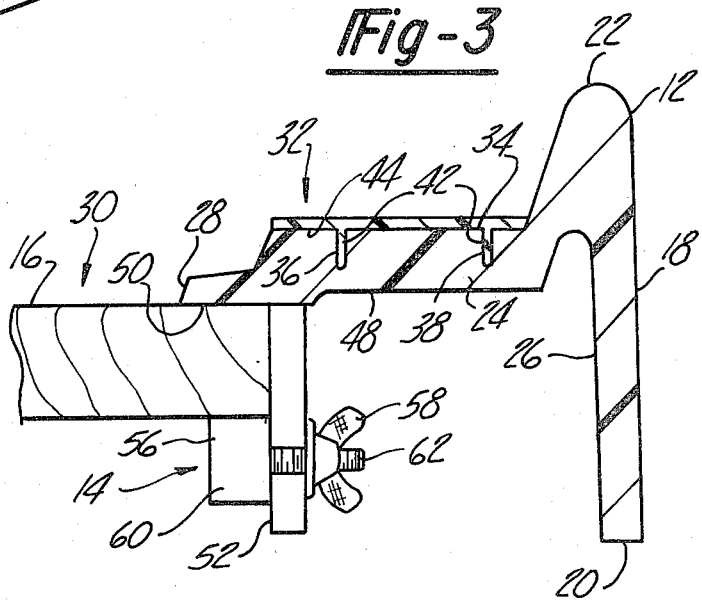
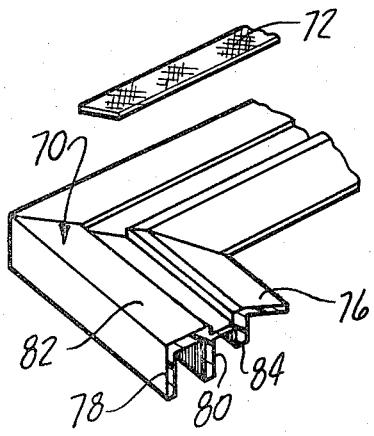
Fig-4

PICTURE FRAME ASSEMBLY

BACKGROUND OF THE INVENTION

I. Field of the Invention

The present invention relates generally to picture frames and more specifically to frames having variable depth geometry.

II. Description of the Prior Art

The present unavailability of inexpensive picture frames presents a substantial negative economic burden in the marketing of low cost original paintings and similar works of art consisting of substantially flat objects. Responsive to this need, attempts have been made to provide frames of a configuration capable of manufacture by modern high volume production techniques. An example of such frames may be seen in Applicant's U.S. Pat. No. 3,879,873 which discloses a two-piece frame assembly of a configuration which may be fabricated by injection molding or similar process and which provides for varying the depth of the frame between discrete positions to mount flat objects of various thicknesses.

Certain disadvantages have been found to exist in the manufacture and use of such frames, however.

One disadvantage is that the multiplicity and complexity of parts results in less than the most economical adjustable depth frame assembly possible to frame the desired flat objects.

Another disadvantage is that the prior art frames may not be readily changed in outward appearance without disassembly of the frame.

Still another disadvantage is the limitation on the number of different thicknesses of flat objects that can be accommodated owing to the discrete varying of frame depth taught by the prior art.

SUMMARY OF THE INVENTION

Responsive to the noted disadvantages in the prior art, it is an object of the present invention to provide a picture frame assembly having a minimal number of minimally complex parts for effecting the mounting of flat objects of various thicknesses.

It is another object to provide a frame assembly capable of being changed in outward appearance without disassembly.

It is still another object to provide a frame assembly affording infinitely variable depth positioning.

According to one feature of the present invention, a frame assembly is provided comprising a simple unitary frame member and locking members for securing flat objects of varying thickness therein.

According to another object, a frame assembly is provided which includes a plurality of decorative strips detachably received thereby.

According to still another feature, a frame assembly is provided including a unitary frame member and a plurality of locking members attachable thereto at infinitely adjustable depth to support flat objects of varying thickness.

BRIEF DESCRIPTION OF THE DRAWINGS

These objects and features as well as others will become obvious to those skilled in the art of picture frames upon reference to the following specification and drawings in which:

FIG. 1 is a rear perspective, partially cross-sectional view of the frame assembly of the present invention;

FIG. 2 is a front perspective, exploded view of the frame assembly of the present invention;

FIG. 3 is an enlarged cross-sectional view of the frame assembly of the present invention; and FIG. 4 is a fragmentary view illustrating a preferred modification of the present invention.

DESCRIPTION OF THE PREFERRED EMBODIMENT

Referring now to the drawings, a picture frame assembly 10 is illustrated as comprising essentially a unitary frame member 12 and a plurality of locking members 14 for securing a flat object such as a painting 16 or the like to the frame member 12 for display therein.

Frame member 12 comprises a generally box-like structure of a configuration suitable for fabrication by high volume production techniques such as injection molding or extrusion. As may best be seen in FIG. 3, it includes a straight outer peripheral side wall 18 having a straight rear edge 20 for abutting a flat display surface such as a wall and a front surface 22 which is illustrated as being formed as a rounded surface but which may be modified for alternative decorative visual effects. A flange portion 24 extends inwardly from the inner surface 26 of side wall 18 and terminates at an inner peripheral edge 28 to define an aperture 30 for viewing the painting 16. The front face 32 of the flange portion 24 includes a substantially flat surface 34 in which is a pair of slots 36, 38 extending parallel to the side wall 18. In one preferred embodiment of the invention frame assembly, decorative strips 40 which include a plurality of tabs 42 formed on the rear face 44 thereof are inserted to detachably engage the slots 36, 38 thereby permitting the outward appearance of the frame assembly 10 to be readily changed. As is shown in FIG. 2, the ends 46 of the strips 40 may be formed to create the appearance of a mitered corner in the frame assembly 10 when four strips are used, but other decorative configurations are, of course, possible.

Turning now to FIGS. 1 and 3, the flange portion 24 is illustrated as including a rear face 48 which includes a substantially flat mounting surface 50 for abuttingly engaging the painting 16. A plurality of rearwardly extending locking flanges 52 are formed, preferably integrally, adjacent the mounting surface 50 and have a slot 54 extending substantially the length thereof for receiving the locking members 14.

Each locking member 14 comprises a T-bolt member 56 and a suitable threaded locking fastener, such as a wing nut as depicted at 58. The T-bolt member 56 includes an enlarged, substantially rectangular supporting portion 60 and a threaded locking portion 62 sized to be loosely received in the slot 54 of locking flange 52.

Also extending rearwardly from the rear face 48 of flange portion 24 is at least one mounting flange 64 which may include, as illustrated in FIG. 1, a pair of posts 66, 68 for receiving fasteners such as screws 70, 72 for attaching a known hanger plate 74.

FIGS. 1 and 3 graphically illustrate how flat objects such as the painting 16 of varying thickness may be readily displayed in the simple, economically producible frame assembly described. The painting 16 is inserted from the rear into the frame member 12 to abut the mountig surface 50. Lateral movement is restrained by the locking flanges, and rearward support is effective by sliding the T-bolt members 14 along the slots 54 until the supporting portion 60 thereof abuts the painting 16 and threadedly lockingly engages the wing nut 58 against the locking flange portion 52. Infinite depth adjustment and effective locking support of a flat object such as the painting 16 is thus afforded.

FIG. 4 illustrates a modified picture frame 70 in which the decorative strips 40 of the embodiment of FIGS. 1–3 are replaced by adhesively mounted strips 72 which fit in a slot found between face portion 82 and flange portion 76. Like the frame shown in FIGS. 1–3 the frame 70 is provided with a side wall 78 and a locking flange 80 to accommodate the locking members 14 (not shown). The painting 16 (not shown) has its upper face abutting a downwardly extending flange 84 of the frame. While several preferred embodiments and modifications of the invention frame assembly have been described, others may be possible to those skilled in the art without departing from the scope of the appended claims.

What is claimed is:

1. A frame assembly for mounting a flat object, the frame assembly comprising:

a unitary box-shaped frame member having a front face and a rear face and a viewing aperture extending therebetween;

a plurality of flat locking flanges disposed adjacent said aperture and extending rearwardly from said rear face and said frame member so that the plane of the flanges is substantially parallel to the axis of the viewing aperture whereby the flat object is freely axially insertable between the locking flanges and, upon insertion, the locking flanges support said flat object against lateral movement;

wherein said locking flanges each include an axially extending through slot opening rearwardly and terminating at their other end proximate said frame member rear face;

a plurality of locking members lockingly engageable with said locking flanges at infinitely adjustable axial positions with respect to said frame member rear face and adapted to clampingly engage said flat object to said frame member rear face; said locking members each comprising a T-bolt member having a supporting portion and a threaded shank extending outwardly from the supporting portion; a fastener which threadably engages the shank, said shank being slidably received in said slot when said fastener is partially threaded onto the shank and so that the supporting portion abuttingly engages said flat object, and so that the fastener is positioned on the side of the flange opposite from the flat object, whereby, upon tightening the fastener, the locking member becomes clamped to the locking flange and the supporting portion prevents axial movement of the flat object.

2. A frame assembly as defined in claim 1 and further comprising a plurality of decorative strips detachably secured to said frame member front face.

3. A frame assembly as defined in claim 1 wherein said locking flanges are formed integrally with said frame member.

4. A frame assembly as defined in claim 2 wherein pairs of spaced parallel slots are formed in said frame member front face extending peripherally about and proximate to said viewing aperture and pairs of spaced, parallel, elongated tabs are formed on said strips slidingly engageable with said slots for detachable insertion therein.

5. A frame assembly as defined in claim 2 and including a slot formed in said frame member and said strips being adhesively secured to said frame member on said slots.

6. A frame assembly for mounting a flat object, the frame assembly comprising;

a unitary box-shaped frame having a front face and a rear face and a viewing aperture extending therebetween;

a plurality of locking flanges disposed adjacent said aperture, extending rearwardly from said rear face, and laterally supporting said flat object; and a plurality of locking members lockingly engageable with said locking flanges at infinitely adjustable axial positions with respect to said frame member rear face and adapted to clampingly engage said flat object to said frame member rear face; and wherein said locking flanges each include an axially extending through slot opening rearwardly and terminating proximate said frame member rear face and said locking member each comprising a T-bolt member received in said slot and adapted to abuttingly engage said flat object, and a locking fastener.

7. A frame assembly for mounting a flat object, the frame assembly comprising:

a unitary box-shaped frame having a front face and a rear face and a viewing aperture extending therebetween;

a plurality of locking flanges disposed adjacent said aperture, extending rearwardly from said rear face, and laterally supporting said flat object;

wherein said locking flanges each include an axially extending through slot which opens rearwardly through the flanges and which terminates at their other end proximate the rear face of the frame; and a plurality of locking members lockingly engageable with said locking flanges at infinitely adjustable axial positions with respect to said frame member rear face and adapted to clampingly engage said flat object to said frame member rear face, said locking members each having a portion which is axially freely slidably received within the slot of one locking flange through the open end of the slot.

* * * * *